United States Patent [19]

Rapayelian

[11] 4,349,974

[45] Sep. 21, 1982

[54] ASSEMBLY FOR MOUNTING A PICTURE TO BE DISPLAYED

[75] Inventor: Christian Rapayelian, Marseilles, France

[73] Assignee: Societe Brio, Societe Anonyme, Corbas, France

[21] Appl. No.: 281,371

[22] Filed: Jul. 8, 1981

[51] Int. Cl.[3] ..... G09F 1/12

[52] U.S. Cl. ..... 40/156; 40/10 R

[58] Field of Search ..... 40/10 R, 152, 152.1, 40/152.2, 156; 52/740

[56] References Cited

U.S. PATENT DOCUMENTS

| | | | |
|---|---|---|---|
| 2,450,330 | 9/1948 | DeGiers | 40/156 |
| 2,489,477 | 11/1949 | Brecher | 40/156 |
| 3,820,298 | 6/1974 | Kirsch | 40/156 |
| 4,027,413 | 6/1977 | Moede | 40/156 |

*Primary Examiner*—Gene Mancene
*Assistant Examiner*—Wenceslao J. Contreras
*Attorney, Agent, or Firm*—Karl F. Ross

[57] ABSTRACT

A picture frame with a rabbeted inner periphery, forming an abutment for a stack including a glass pane, a decorative insert and a backing plate, has an inner peripheral groove in a plane paralleling the rabbet and another groove transverse to that plane close to the outer edge of the rear face of each of its members. One or more clips of elastic material (metal or plastic) engage each frame member from the rear, each clip having a channel profile with mutually perpendicular lips snap-fitted into the inner and outer grooves and further having at least one dovetailed transverse mortise open toward the interior and the rear of the frame. Each clip is engaged by at least one elbow of similar elastic material with two arms adjoining each other at an acute angle, either of these arms fitting tightly into a corresponding mortise while the other arm bears resiliently upon the rear surface of the stack resting against the rabbet. The clips may be straight bars, slidably fitted onto individual frame members, or angle pieces engaging the corners of the frame.

6 Claims, 6 Drawing Figures

ASSEMBLY FOR MOUNTING A PICTURE TO BE DISPLAYED

FIELD OF THE INVENTION

My present invention relates to an assembly for the mounting and framing of a flat carrier of rectangular outline bearing a message to be displayed. The term "message" is intended to encompass a variety of decorative or informative representations including writings, drawings, paintings and photographs.

BACKGROUND OF THE INVENTION

The conventional way of holding a picture or the like in a surrounding frame involves the use of retaining elements which are nailed, glued or otherwise secured to the inner frame periphery in order to engage a rear surface of a stack usually formed by a glass pane and a backing plate between which the picture is sandwiched, this stack resting against a peripheral rabbet formed by the frame members. The removal of these retaining elements for any purpose, e.g. for changing the display or for replacing a broken glass pane, tends to damage the frame or at least to weaken the hold of these elements upon their subsequent re-emplacement.

OBJECT OF THE INVENTION

The general object of my present invention, therefore, is to provide an assembly of the type referred to whose retaining elements can be readily removed and restored without any structural impairment of the elements themselves or of the associated frame.

A more particular object is to provide means in such an assembly for accommodating message carriers of different thicknesses.

SUMMARY OF THE INVENTION

I realize these objects, in accordance with my present invention, by providing a four-sided frame whose rabbeted inner periphery forms a planar abutment for a rectangular message carrier, the frame being provided on at least two opposte sides with two mutually perpendicular grooves. One groove extends along the inner periphery of the frame, parallel to and rearwardly of the abutment plane, while the other groove is transverse to that plane and extends on a rear frame face parallel to its inner periphery. The frame is engaged on the aforementioned sides by a plurality of clips of elastic material (metal or plastic) which overlie part of its rear face and have a channel profile with mutually perpendicular first and second clips respectively entering the inner peripheral groove and the transverse groove of the corresponding frame side, each clip further having at least one transverse mortise with undercut (preferably beveled) edges which is open to the interior and to the rear of the frame. Each clip is engaged by at least one detachable elbow of preferably the same elastic material having two arms adjoining each other at an acute angle, one arm being frictionally fitted from behind into a mortise of the clip while the other arm resiliently bears upon the rear surface of the message carrier.

Advantageously, pursuant to a more particular feature of my invention, the two arms of each elbow are of different lengths but identical cross-section so that either of them can be inserted into a mortise of an associated clip, depending on the thickness of the carrier to be retained.

Such a clip may be in the shape of a straight bar which can be slid along a frameside into any desired position. At least some of the clips of a mounting assembly according to my invention may, however, be designed as angle members with two mutually orthogonal legs engaging the frame at its corners.

BRIEF DESCRIPTION OF THE DRAWING

The above and other features of my invention will now be described in detail with reference to the accompanying drawing in which.

SPECIFIC DESCRIPTION

Figure 1:
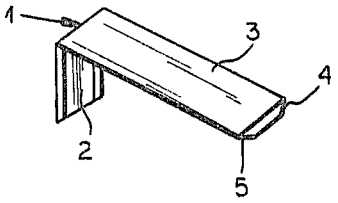
FIG. 1 is a perspective view of an elbow for a mounting assembly according to my invention.
Figure 4:
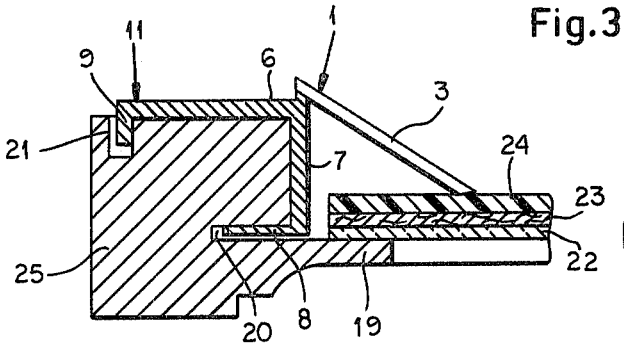
FIG. 4 is a cross-sectional view of a frame member engaged by a clip of the type shown in FIG. 2, this view also illustrating part of a stack retained by the elbow of FIG. 1.
Figure 5:
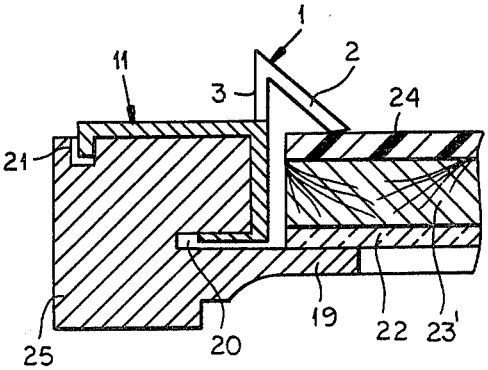
FIG. 5 is a view similar to FIG. 4, showing the elbow inverted to retain a stack of greater thickness.

FIG. 1 illustrates an elbow-shaped retaining element 1 provided with a shorter arm 2 and a longer arm 3 adjoining each other an an acute angle, e.g. of 45° to 60° as more clearly shown in FIGS. 4 and 5. Each arm has a trapezoidal cross-section with two bevelved edges 4 and 5.

Figure 2:
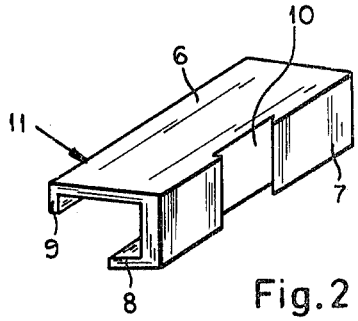
FIG. 2 is a perspective view of a straight clip used in such an assembly.

FIG. 2 shows a clip 11 in the form of a bar with a channel profile defined by two orthogonally adjoining sidewalls 6, 7 which terminate at their free edges in two lips 9 and 8 respectively perpendicular thereto. The height of lip 9 as measured from the adjoining sidewall is less than that of lip 8; as illustrated, lip 9 is less than half as high as the sidewall 7 parallel thereto. This sidewall is formed with a dovetail-shaped mortise 10 whose cross-section has the same trapezoidal shape as arms 2 and 3 of elbow 1 (FIG. 1); thus, either of these arms can be inserted with a tight frictional fit into mortise 10 from a rear end thereof, i.e. from its upper end as viewed in FIG. 2.

Figure 3:
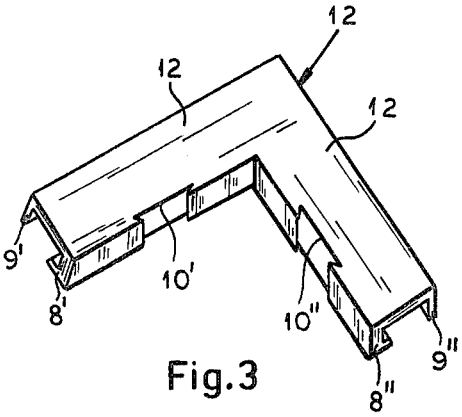
FIG. 3 is a view similar to FIG. 2 but showing an angled clip to be used at a corner of an associated frame.

In FIG. 3 I have shown an alternate clip 12 consisting of two mutually orthogonal legs 12' and 12'' each having the same channel profile as the straight clip 11 of FIG. 2, the lips 8', 9' and a mortise 10' in the case of leg 12' and lips 8'', 9'' and a mortise 10'' in the case of leg 12''. The elbow 1 and the clips 11, 12, of FIGS. 2 and 3 may be made from sheet metal or resinuous material of suitable elasticity.

FIG. 4 illustrated part of a mounting assembly including a member 25 of a frame 18 (FIG. 6) with a projecting ledge 19 which forms a peripheral rabbet around the frame opening. As particularly shown for member 25, each frame member has an inner peripheral groove 20 which is parallel to its ledge 19 and, in the illustrated embodiment, is bounded by a forward wall flush with the rear surface of that ledge. Another groove 21, perpendicular to ledge 19, extends close to an outer edge of the frame member on a rear face thereof which is partly overlain by a clip 11 such as the one shown in FIG. 2. Lip 8 of clip 11 penetrats into groove 20 while lip 9 engages in the shallower groove 21 into which it is inserted with a snap fit, thanks to the resiliency of the clip. The grooves 20 and 21 extend over the entire length of the four frame members 25–28 shown in FIG. 6. Each clip 11 frictionally grips the associated frame member and can be slid therealong into any desired position.

Figure 6:
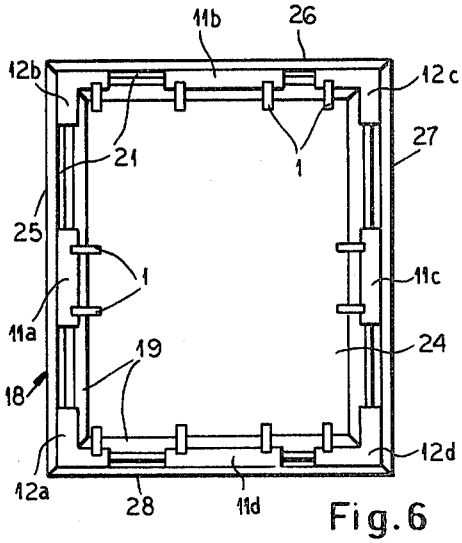
FIG. 6 is a rear view of a frame provided with straight and angled clips of the type shown in FIGS. 2 and 3.

A carrier of a message to be displayed in the frame 18, partly illustrated in FIG. 4, comprises a stack formed from a glass pane 22, a sheet 23 with a painted or otherwise decorated front face (lower surface in FIG. 4), and a backing plate 24 of relatively rigid material. An elbow 11, fitted with its shorter leg 2 (FIG. 1) into the mortise 10 (FIG. 2) of clip 11, bears with its longer leg 3 upon the rear surface of the stack 22–24 so as to hold the same in firm contact with ledge 19. As illustrated in FIG. 6, each of the four frame members 25–28 is engaged by a respective clip 11*a*–11*d* which in this instance has two parallel mortises holding a pair of elbows 1. FIG. 6 further shows the frame 18 engaged at its corners by respective angled clips 12*a*–12*d* similar to the one shown in FIG. 3. In some instances, however, it may be sufficient to use only clips 11*a*, 11*c* on the major frame sides 25, 27 or clips 11*b*, 11*d* on the minor frame sides 26, 28. Conversely, the presence of the four corner clips 12*a*–12*d* may eliminate the need for any sliding clip. Generally, of course, clips 11 and 12 can be used in any desired combination.

As indicated in FIG. 5, the elbow 1 engaging the clip 11 may be inverted so that its longer arm 3 fits into the mortise 10 (FIG. 2), its shorter arm 2 then bearing on the rear surface of a somewhat heavier stack which in this instance includes a relatively thick decorative body 23', possibly a laminate or a woodcut, in lieu of the sheet 23 shown in FIG. 4. Thus, the assembly according to my invention can be readily adapted to different message carriers that are to be mounted within the opening of frame 18.

I claim:

1. An assembly for mounting a flat carrier of rectangular outline bearing a message to be displayed, comprising:

a four-sided frame with a rabbeted inner periphery forming a planar abutment for a front surface of said carrier, said frame being provided on at least two opposite sides with an inner peripheral groove extending parallel to and rearwardly of the plane of said abutment and with a transverse groove extending on a rear face of said frame parallel to said inner periphery;

a plurality of clips of elastic material engaging said frame on said opposite sides, each of said clips overlying part of said rear face and having a channel profile with mutually perpendicular first and second lips respectively entering said inner peripheral groove and said transverse groove of the corresponding frame side, each of said clips being further provided with at least one transverse mortise with undercut edges open to the interior and to the rear of the frame; and a plurality of detachable elbows of elastic material respectively engaging said clips, each of said elbows having two arms adjoining each other at an acute angle, one of said arms being frictionally fitted from behind into a mortise of the respective clip while the other arm resiliently bears upon a rear surface of said carrier.

2. An assembly as defined in claim 1 wherein said arms are of different lengths but identical cross-section, complementary to that of the mortise, for selective insertion into said mortise.

3. An assembly as defined in claim 2 wherein the cross-sections of said mortise and said arms are trapezoidal.

4. An assembly as defined in claim 1, 2 or 3 wherein said second lip is of lesser height than said first lip.

5. An assembly as defined in claim 1, 2 or 3 wherein at least some of said clips form straight bars slidable along respective frame sides.

6. An assembly as defined in claim 1, 2 or 3 wherein at least some of said clips are angle members with two mutually orthogonal legs and are in engagement with respective corners of said frame.

* * * * *